US011318489B2

(12) United States Patent
Bricaud

(10) Patent No.: US 11,318,489 B2
(45) Date of Patent: May 3, 2022

(54) FLUID PRODUCT DISPENSER

(71) Applicant: APTAR FRANCE SAS, Le Neubourg (FR)

(72) Inventor: Gerard Bricaud, Oyonnax (FR)

(73) Assignee: APTAR FRANCE SAS, Le Neubourg (FR)

( * ) Notice: Subject to any disclaimer, the term of this patent is extended or adjusted under 35 U.S.C. 154(b) by 0 days.

(21) Appl. No.: 17/274,934

(22) PCT Filed: Sep. 16, 2019

(86) PCT No.: PCT/FR2019/052149
§ 371 (c)(1),
(2) Date: Mar. 10, 2021

(87) PCT Pub. No.: WO2020/058618
PCT Pub. Date: Mar. 26, 2020

(65) Prior Publication Data

US 2022/0032331 A1 Feb. 3, 2022

(30) Foreign Application Priority Data

Sep. 18, 2018 (FR) ..... 1858441

(51) Int. Cl.
*B05B 11/00* (2006.01)
*A45D 34/04* (2006.01)

(52) U.S. Cl.
CPC ..... *B05B 11/3015* (2013.01); *A45D 34/04* (2013.01); *B05B 11/0038* (2018.08);
(Continued)

(58) Field of Classification Search
CPC ..... B05B 11/3015; B05B 11/0038; B05B 11/00416; B05B 11/3052; A45D 2200/055; A45D 2200/056; A45D 34/04
(Continued)

(56) References Cited

U.S. PATENT DOCUMENTS 8,308,029 B2 * 11/2012 Ki ..... B05B 11/3008 222/309
9,681,731 B2 * 6/2017 Jo ..... B05B 11/3052
(Continued)

FOREIGN PATENT DOCUMENTS

EP 2 859 958 A1 4/2015
WO 2012/161494 A2 11/2012
WO 2017/211585 A1 12/2017

OTHER PUBLICATIONS

International Preliminary Report on Patentability dated Mar. 23, 2021 in International Application No. PCT/FR2019/052149.
(Continued)

*Primary Examiner* — Jeremy Carroll
(74) *Attorney, Agent, or Firm* — Sughrue Mion, PLLC

(57) ABSTRACT

A dispenser having a fluid reservoir (1); a dispenser member (2) having a body (21) and an actuator rod (22) movable over a maximum rod stroke; a dispenser orifice (46); a rotary actuator member (4); a transmission member (5) that is engaged both with the dispenser member (2) and also with the rotary actuator member (4); and a cam mechanism (43, 55) for transforming turning of the rotary actuator member (4) into an axial movement of the actuator rod (22) or of the body (21). The cam mechanism (43, 55) defines a maximum cam stroke that is greater than the maximum rod stroke; and a resilient mechanism (56) acts axially to compensate for the extra amount of the maximum cam stroke and thus allow it to be followed so as to guarantee that the rod performs its maximum stroke in full.

11 Claims, 4 Drawing Sheets

Figure 1:
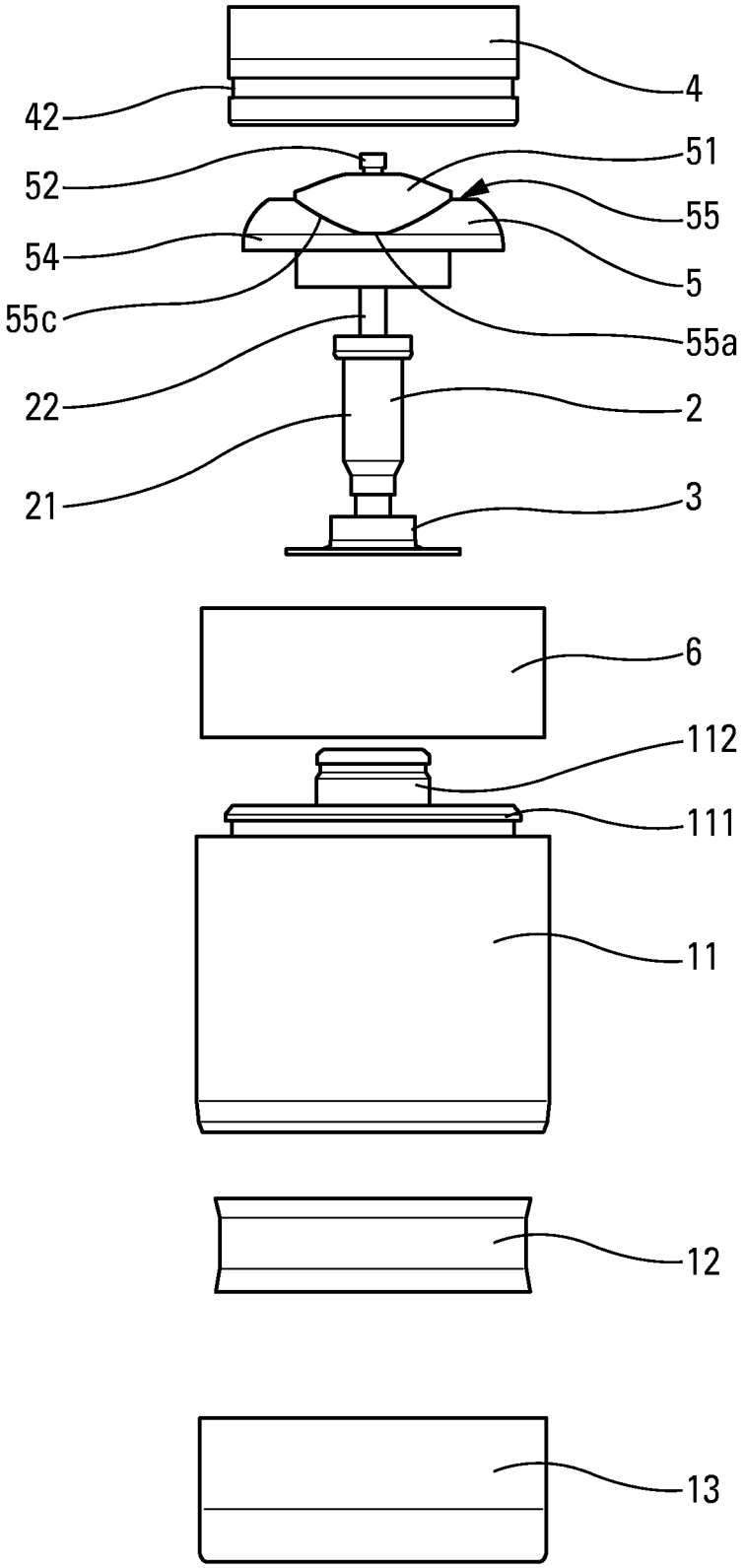

(52) U.S. Cl.
CPC .... *B05B 11/00416* (2018.08); *B05B 11/3052* (2013.01); *A45D 2200/055* (2013.01); *A45D 2200/056* (2013.01)

(58) Field of Classification Search
USPC ..... 222/401
See application file for complete search history.

(56) References Cited

U.S. PATENT DOCUMENTS

| | | | | |
|---|---|---|---|---|
| 2014/0231464 | A1 | 8/2014 | Cho | |
| 2016/0058154 | A1* | 3/2016 | Jung | A45D 34/04 222/382 |
| 2017/0157377 | A1 | 6/2017 | Chang et al. | |
| 2018/0290794 | A1* | 10/2018 | Duquet | B65D 47/04 |
| 2021/0323734 | A1* | 10/2021 | Zembrod | B65D 35/46 |

OTHER PUBLICATIONS

International Search Report for PCT/FR2019/052149 dated Jan. 3, 2020 (PCT/ISA/210).

* cited by examiner

FLUID PRODUCT DISPENSER

CROSS REFERENCE TO RELATED APPLICATIONS

This application is a National Stage of International Application No. PCT/FR2019/052149 filed Sep. 16, 2019, claiming priority based on French Patent Application No. 1858441 filed Sep. 18, 2018.

The present invention relates to a fluid dispenser comprising a fluid reservoir and a dispenser member through which the fluid is delivered. The dispenser member comprises a body and an actuator rod that is axially movable down and up relative to the body over a maximum rod stroke. The dispenser also comprises a dispenser orifice where a user may recover the dispensed fluid, in addition the dispenser comprises a rotary actuator member that the user can turn about its own axis, and a transmission member that is engaged both with the body or the actuator rod of the dispenser member and also with the rotary actuator member. Cam means are formed by the rotary actuator member and by the transmission member for transforming turning of the rotary actuator member into an axial movement of the actuator rod or of the body. That type of dispenser may be referred to as a "rotary actuated dispenser". It finds an advantageous application in the fields of cosmetics and pharmacy, without excluding foodstuffs and household cleaners.

In the prior art, and by way of example, document EP 2 859 958 is known, which describes a rotary actuated dispenser including a rotary actuator member forming a cam path. The actuator rod of the pump forms two opposite pins that follow the cam path. The actuator rod is connected to a ball applicator by means of a sliding telescopic connection. Given the manufacturing tolerances of the various parts that constitute the dispenser, and given the clearances between the parts, it is not certain that the actuator rod is fully depressed when the two pins reach their lowest position. It is thus not certain that the entire dose has been dispensed on each turn. In other words, the maximum stroke of the pins is not necessarily equal to the maximum stroke of the actuator rod.

An object of the present invention is to remedy that drawback of the prior art by defining a rotary actuated dispenser that reliably and reproducibly delivers the entire dose of fluid. The dispenser of the invention guarantees that the actuator rod is depressed fully.

To do this, the present invention proposes that:

- the cam means define a maximum cam stroke that is greater than the maximum rod stroke; and that
- resilient means act axially so as to compensate for the extra amount of the maximum cam stroke and thus allow it to be followed so as to guarantee that the rod performs its maximum stroke in full.

It is the extra amount by which the cam stroke exceeds the maximum rod stroke that ensures that the actuator rod is depressed fully. However, this extra amount of cam stroke could prevent the rotary actuator member from being fully actuated or from being blocked in turning. And it is precisely the resilient means that enable the rotary actuator member to be fully actuated by absorbing, or by compensating for, or by accommodating, this extra amount of cam stroke. Better still, the resilient means may create a harder point that the user can feel, informing the user almost intuitively that the angular stroke of the rotary actuator member is close to its end. In other words, the resilient means can give rise to a dynamic friction force that increases as the actuator rod comes close to being fully depressed. Thus, not only is the dose of fluid dispensed in full, but the dispenser may also be more agreeable and ergonomic to operate.

Advantageously, the cam means comprise at least one cam path of axial height that varies, and at least one cam follower that follows the respective cam path. The cam path may be secured to the transmission member or to the rotary actuator member. The transmission member may act on the actuator rod or on the body. By way of example, it is possible to envisage that the transmission member acts on the bottom of the reservoir on which the dispenser member is mounted. Thus, the actuator rod may be moved relative to a stationary body, or, on the contrary, the rod may be static and it is then the body and the reservoir that are moved relative to the stationary rod.

In an advantageous embodiment, the transmission member comprises a central cap that is engaged with the actuator rod, and a cam ring that defines at least one cam path of axial height that varies. The resilient means may then be formed by the transmission member. The cam ring may be connected to the central cap via a plurality of flexible bridges forming the resilient means and/or the cam ring is elastically deformable so as to form the resilient means. The rotary actuator member may then include a plurality of profiles forming cam followers that come into engagement with the cam paths of the cam ring and that follow them.

In an advantageous aspect of the invention, the rotary actuator member may comprise a rotary actuator ring that a user can grip, and a collection dish in which the user can recover the fluid that has been dispensed. Advantageously, the rotary actuator ring does not move axially, and the collection dish is elastically deformable so as to follow the axial movement of the actuator rod. Preferably, the collection dish is fastened to the central cap of the transmission member, which central cap advantageously forms a connection bushing that is connected to the actuator rod, and an endpiece that is connected to the collection dish.

In a variant or in addition, the resilient means may be formed by the rotary actuator member. The cam ring of the transmission member could be secured to the rotary actuator member by means of flexible bridges. Or the profiles of the rotary actuator member that follow the cam path of the cam ring could be elastically deformable or movable. The profiles could be formed by flexible tabs or blades.

The spirit of the invention resides in providing an extra amount of cam stroke that is "attenuated, compensated for, or allowed", by elastically deforming at least one of the parts that is involved in the system of transforming turning movement into translation movement by cam means. Such elastic deformation can take place in the rotary actuator member and/or in the transmission member. The embodiments can be presented in numerous versions by the person skilled in the art. Any deformation that causes axial resilient bending is possible. The flexible collection dish that connects the rotary ring to the actuator rod is an advantageous characteristic that may be implemented independently of the extra amount of cam stroke and of the associated resilient means.

The invention is described more fully below with reference to the accompanying drawings which show three embodiments of the invention by way of non-limiting example.

Figure 2A:
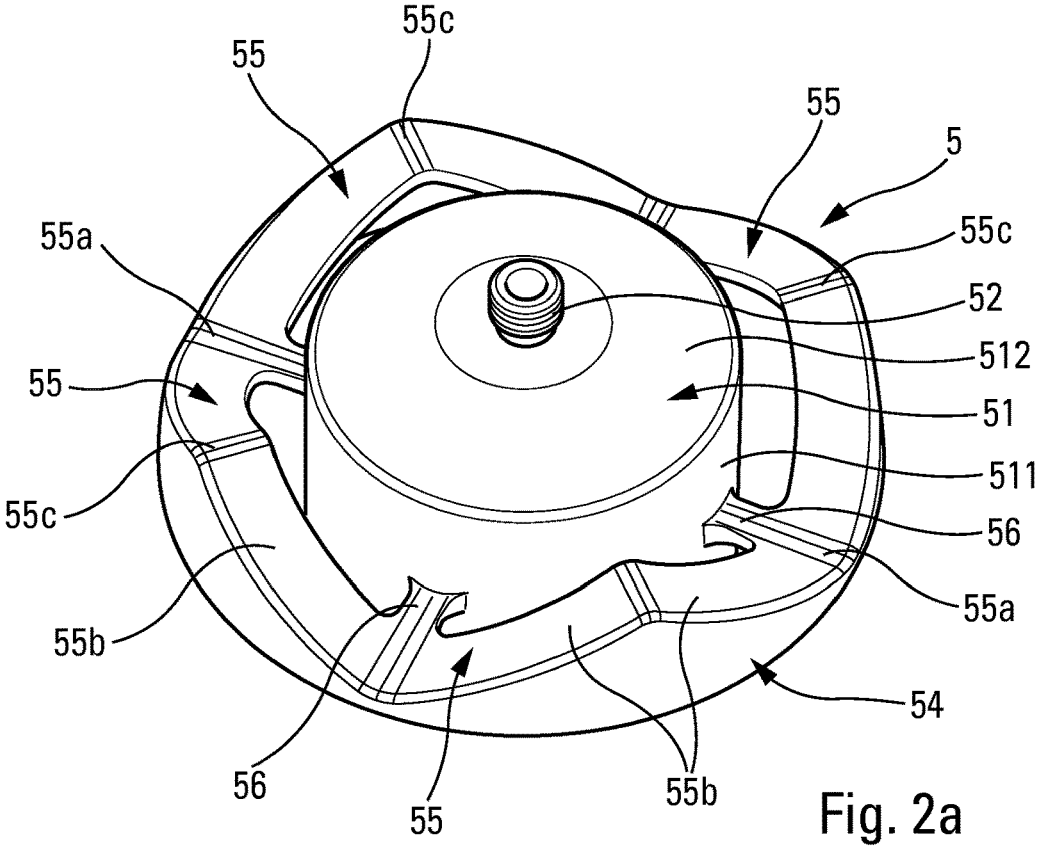
Figure 2B:
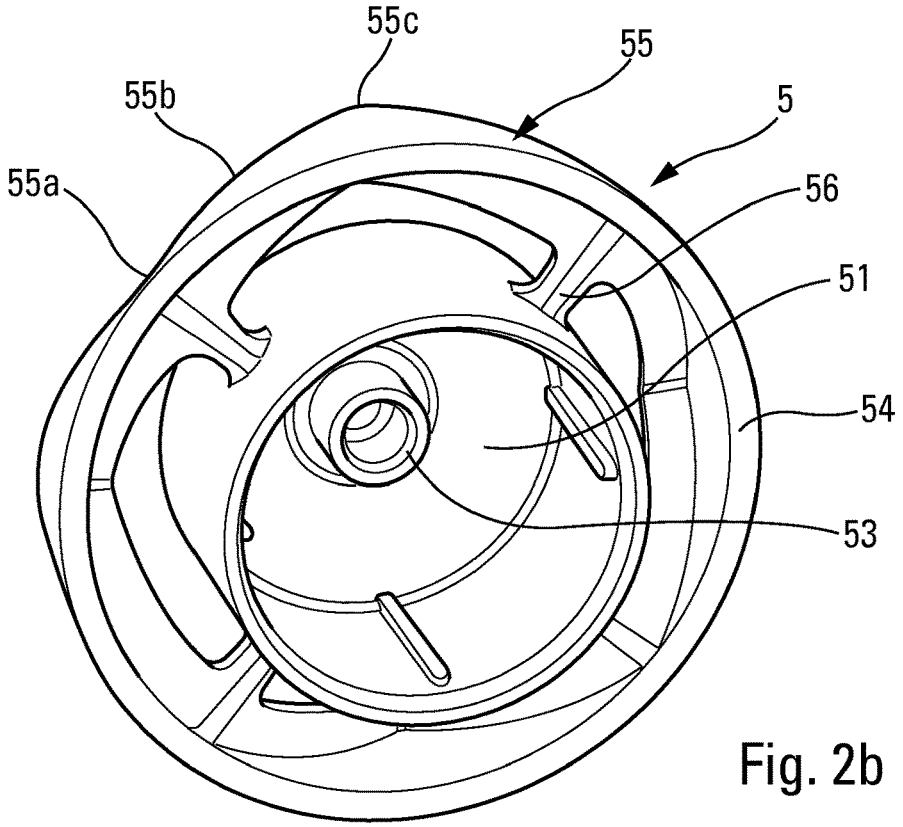
Figure 3B:
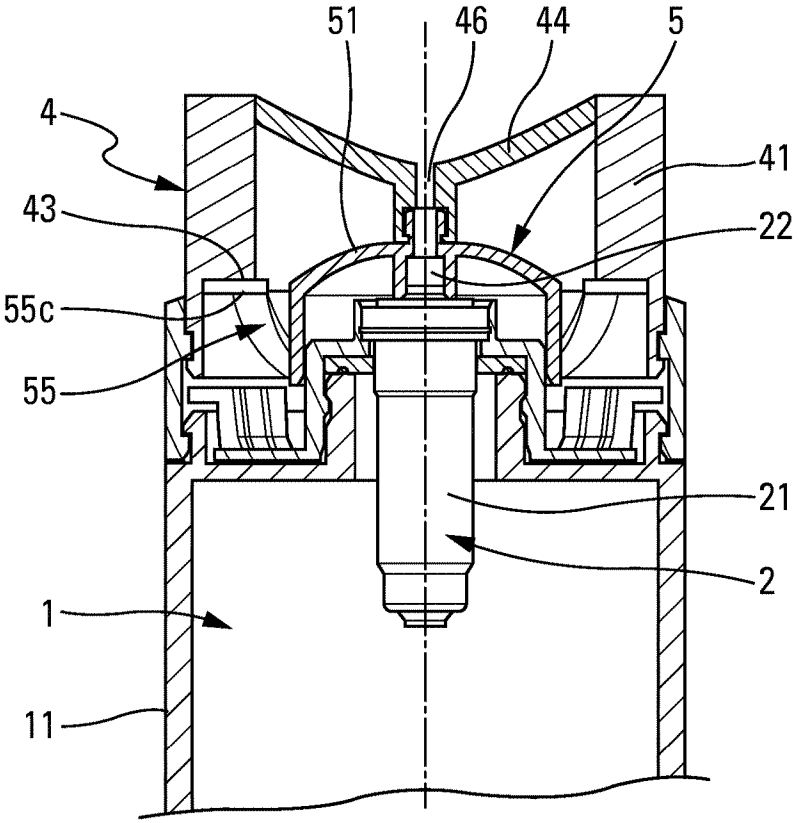
Figure 3A:
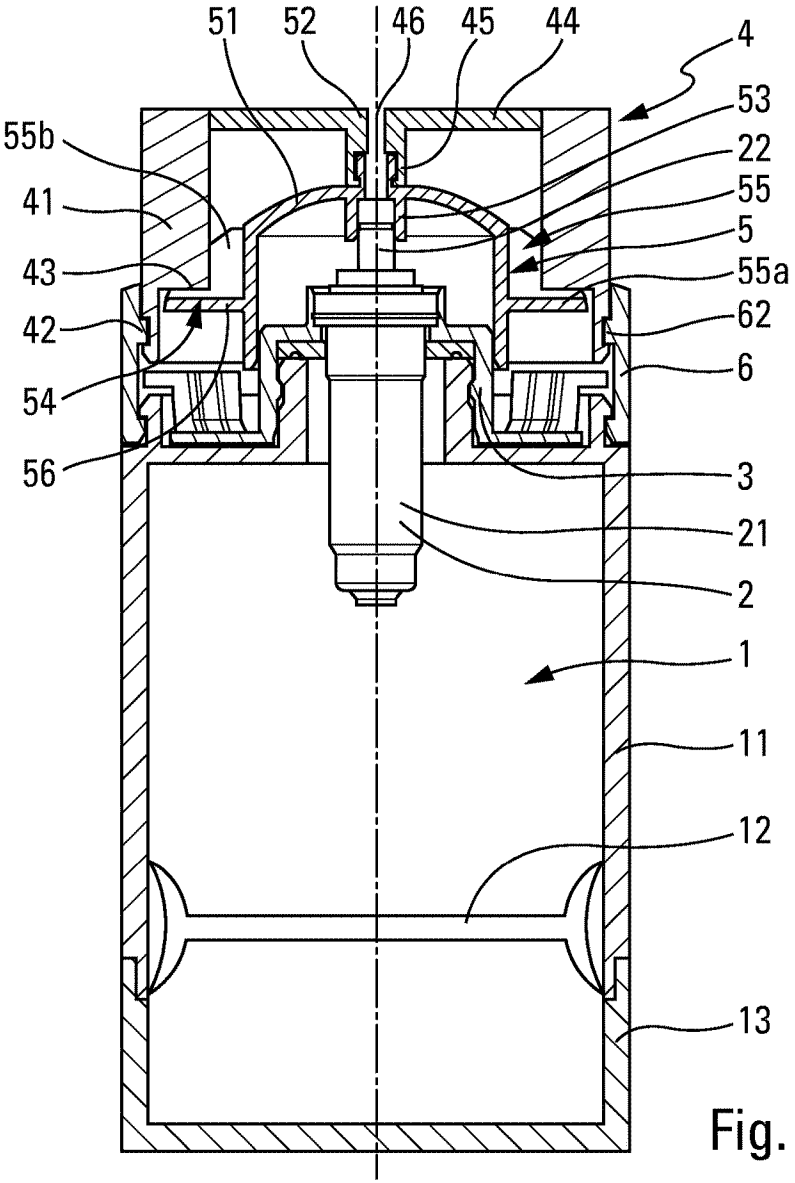
Figure 4:
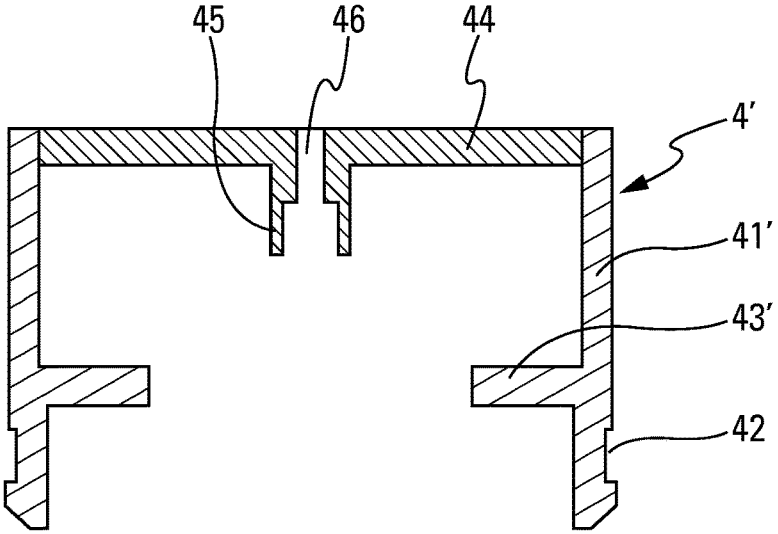
Figure 5:
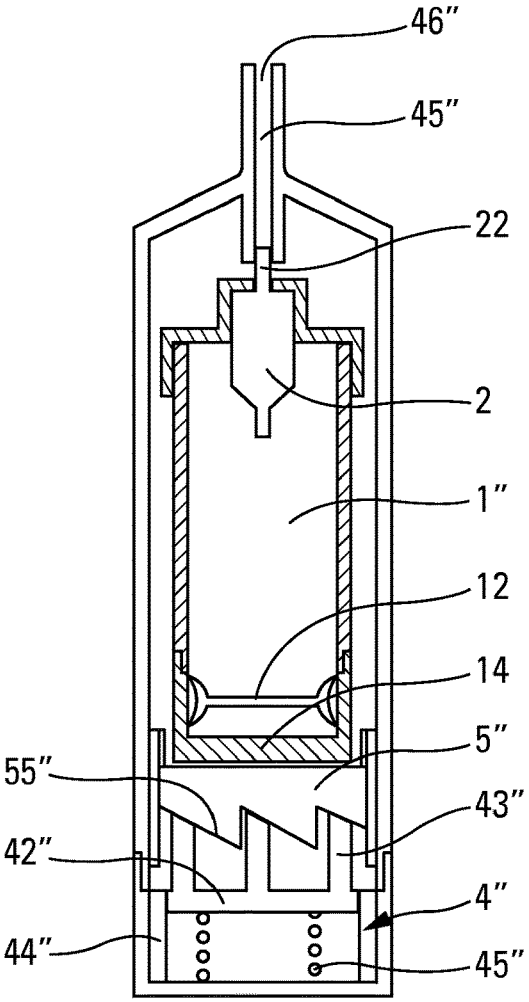

In the figures:

FIG. 1 is an exploded perspective view of a dispenser constituting an embodiment of the invention;

FIGS. 2*a* and 2*b* are larger-scale perspective views of the FIG. 1 transmission member;

FIGS. 3*a* and 3*b* are vertical section views through the FIG. 1 dispenser, respectively in its rest position and in its actuated position;

FIG. 4 is a vertical section view through a rotary actuator member constituting another embodiment of the invention; and FIG. 5 is a diagrammatic vertical section view through a dispenser constituting another embodiment of the invention.

Reference is made firstly to FIGS. 1 to 3*b* in order to describe a dispenser constituting a first embodiment of the invention. As can be seen in FIG. 1, the dispenser comprises a plurality of component elements, namely: a container body 11 that defines a shoulder 111 and a neck 112; a follower piston 12; a container bottom 13; a covering hoop 6; a dispenser member 2 that in this embodiment is a pump; a reception ring 3; a rotary actuator member 4; and a transmission member 5. The covering hoop 6 and the container bottom 13 are elements that are optional.

In FIGS. 2*a* and 2*b*, the transmission member 5 is shown on a much larger scale so that details can be seen. It includes a central cap 51 that defines a cylindrical portion 511 that is surmounted by a top wall 51 in the shape of a dome. At its center, the outside of the wall 51 forms an outer endpiece 52 having a function that is explained below. As can be seen in FIG. 2*b*, the inside of the top wall 51 forms a connection bushing 53 that is axially in alignment with the endpiece 52. The function of the connection bushing 53 is explained below. A duct extends through the outer endpiece 52 and the connection bushing 53.

The transmission member 5 also includes a cam ring 54 that is arranged coaxially around the central cap 51. Advantageously, the cam ring 51 is connected to the cylindrical portion 511 of the central cap 51 via a plurality of flexible tabs 56 that, in this embodiment, are four in number. As a result, the cam ring 54 can move axially relative to the central cap 51 over a limited axial height, e.g. in the range about a few tenths of a millimeter to about two millimeters. The cam ring 54 defines a plurality of cam paths 55 that, in this embodiment, are four in number. Each cam path 55 comprises two sloping ramps 55*b* that slope in opposite manner, so that they join together at a high point 55*c*. The sloping ramps of a cam path are connected to the sloping ramps of the adjacent cam paths at low points 55*a*, at which the flexible bridges 56 are advantageously formed. Thus, as can be seen more clearly in FIG. 2*a*, the cam ring 54 defines four cam paths 55 that together define eight sloping ramps 55*b*, four high points 55*c*, and four low points 55*a*.

The difference in axial height between the low points 55*a* and the high points 55*b* defines an axial cam stroke that, in the invention, is a little greater than the maximum rod stroke of the dispenser member 2.

It should also be observed that the high points 55*b* are situated mid-way between two flexible bridges 56. As a replacement for the flexible bridges 56 or in addition thereto, provision could also be made for each cam path 55 to be elastically deformable along its length, thereby creating resilient means that would complement the flexible bridges 56 or replace them.

The dispenser member 2 may be a pump or a valve. Either way, the dispenser member 2 comprises a body 21 and a valve rod 22 that are axially movable over a maximum rod stroke. In concrete terms, the maximum rod stroke corresponds to the distance travelled by the actuator rod 22 between its rest position and its position fully depressed inside the body 21. This is entirely conventional for a valve or a pump.

FIG. 3 shows the dispenser in the mounted state. The follower piston 12 is engaged inside the container body 11, and the bottom 13 is fitted to the bottom end of the body 11. In this way, a fluid reservoir 1 is created that, in this embodiment, is of volume that varies as a result of the follower piston 12 moving towards the dispenser member 2. The dispenser member 2 is mounted by means of its fastener ring 3 on the neck of the container body 1. The covering hoop 6 is snap-fastened on the container body 1. The transmission member 5 is mounted on the dispenser member 2 by engaging its connection bushing 53 around the free end of the actuator rod 22. The rotary actuator member 4 is mounted on the transmission member 5 via the inside of the covering hoop 6. More precisely, the rotary actuator member 4 comprises a rotary actuator ring 41 that a user can grip, and a collection dish 44 in which the user can recover the fluid that has been dispensed. The bottom end of the ring 41 is snap-fastened at 42 on a snap-fastener profile 62 that is formed on the inside of the covering hoop 6. In this way, the rotary actuator member 4 is held captive in the hoop 6 while being able to turn about its own axis. The inside of the rotary actuator ring 41 forms a plurality of downwardly-directed shoulders that act as cam followers 43. The cam followers 43 are situated axially just above the cam ring 54. There are as many cam followers 43 as there are cam paths 55. The collection dish 44 is arranged at the top end of the rotary ring 41 and is made out of a flexible material, such as an elastomer. By way of example, the rotary ring 41 and the collection dish 44 may be made by overmolding or bi-injecting different plastics materials. On its bottom face, the collection dish 44 defines a leaktight connection bushing 45 that is in leaktight engagement around the endpiece 52 of the transmission member 5. In this way, an outlet channel is defined that connects the actuator rod 22 to a dispenser orifice 46 defined in the collection dish 44.

In FIG. 3*a*, the dispenser is at rest, with the cam followers 43 arranged at the low points 55*a* of the cam paths 55. The collection dish 44 is at rest, with a shape that is substantially plane. When a user grips the dispenser, the rotary actuator ring 41 can be turned in one direction or the other: the cam followers 43 come into engagement with the sloping ramps 55*b*, thereby causing the transmission member 5 to move axially downwards, given that the rotary actuator member 4 is prevented from moving axially. The cam followers 43 thus move along the sloping ramps 55*b* into the proximity of the high points 55*c*. Just before reaching these tips 55*c*, the actuator rod 22 is normally fully depressed, thereby ensuring that the dose of fluid has been dispensed in full. In order to enable the cam followers 43 to continue up to the tips 55*c* and then cross over to the other side towards the descending ramp, resilient means are provided that act axially so as to compensate for this extra amount of cam stroke and thus allow it to be followed, thereby guaranteeing that the rod performs its maximum stroke in full. In this embodiment, the resilient means are in the form of the flexible bridges 56 and/or the capacity of each cam path 55 to deform.

FIG. 3*b* shows the dispenser in the actuated position, i.e. with the actuator rod 22 fully depressed and the cam followers 43 situated at the tips 55*c*. Deformation of the bridges 56 and/or of each cam path 55 is not shown, since this is difficult to represent.

Once the high points 55*c* have been passed, the cam followers 43 return easily to their low points 55*a* by following the descending ramps 55*b*. Simultaneously, the actuator rod 22 returns progressively towards its extended rest position. In this way, one complete actuation cycle is performed.

It should be kept clearly in mind that this first embodiment is not limiting in any way. Specifically, numerous different variants and versions exist that make it possible to achieve the same result, namely to compensate resiliently for a cam stroke that is longer than the maximum rod stroke. FIG. 4 shows an actuator member 4' that is similar to the actuator member of the first embodiment. However, in this embodiment, the cam followers 43' are formed by thin radial tabs that present sufficient springiness to compensate for, or to overcome, the extra amount of cam stroke. Thus, in this embodiment, the resilient means are formed by the rotary actuator member and not by the transmission member 5, as in the first embodiment.

FIG. 5 shows yet another embodiment in which the transmission member 5" acts on the bottom 14 of a reservoir 1". The transmission member 5" may have an annular profile in the shape of saw teeth 55" that are engaged with corresponding teeth 43" of a cylinder 42" having an outer periphery that is engaged in grooves 44" formed by a rotary actuator member 4". The cylinder 42" is urged against the transmission member 5" by a spring 45".

In this embodiment also, the cam stroke that is defined by the height of the teeth 55" is greater than the maximum rod stroke of the actuator rod 22. When the rotary actuator member 4" is turned, the cylinder 42 is turned in such a manner as to move the tabs 43" along the teeth 55". This causes the actuator rod 22 to be depressed into the dispenser body 2 until the maximum rod stroke is reached. The extra amount of cam stroke formed by the teeth 55" is accommodated or taken up by the spring 45" that enables the cylinder 42' to move axially downwards a little. That enables the teeth 43" to pass over the tips of the teeth 55".

In all of the embodiments, it is preferable for the resilient means to present a resistance to deformation that is greater than the force necessary to depress the actuator rod. As a result, the actuator rod is moved and fully depressed initially, and then only the resilient means (flexible bridges 56, cam path 55, flexible tabs 43', spring 45") move and deform.

Whatever the embodiment described and whatever the position of the transmission member and of the rotary actuator member relative to the actuator rod, provision is made for a cam stroke that is greater than the maximum rod stroke, with the extra amount of cam stroke being compensated for, accommodated, taken up, or merely allowed, by the presence of resilient means that may be incorporated in the transmission member and/or in the rotary actuator member, so as to guarantee that the dose is dispensed in full on each actuation.

The invention claimed is:

1. A fluid dispenser, comprising:

a fluid reservoir;

a dispenser member through which the fluid is delivered, the dispenser member comprising a body and an actuator rod that is axially movable down and up relative to the body over a maximum rod stroke;

a dispenser orifice where a user may recover the dispensed fluid;

a rotary actuator member that the user can turn about its own axis;

a transmission member that is engaged both with the dispenser member and also with the rotary actuator member; and cam means that are formed by the rotary actuator member and by the transmission member for transforming turning of the rotary actuator member into an axial movement of the actuator rod or of the body;

the dispenser being characterized in that:

the cam means define a maximum cam stroke that is greater than the maximum rod stroke; and resilient means act axially so as to compensate for the extra amount of the maximum cam stroke and thus allow it to be followed so as to guarantee that the rod performs its maximum stroke in full.

2. A dispenser according to claim 1, wherein the cam means comprise at least one cam path of axial height that varies, and at least one cam follower that follows the respective cam path.

3. A dispenser according to claim 1, wherein the transmission member comprises a central cap that is engaged with the actuator rod, and a cam ring that defines at least one cam path of axial height that varies.

4. A dispenser according to claim 3, wherein the resilient means are formed by the transmission member.

5. A dispenser according to claim 4, wherein the cam ring is connected to the central cap via a plurality of flexible bridges forming the resilient means and/or the cam ring is elastically deformable so as to form the resilient means.

6. A dispenser according to claim 3, wherein the rotary actuator member includes a plurality of profiles forming cam followers that come into engagement with the cam paths of the cam ring and that follow them.

7. A dispenser according to claim 3, wherein the rotary actuator member comprises a rotary actuator ring that a user can grip, and a collection dish in which the user can recover the fluid that has been dispensed.

8. A dispenser according to claim 7, wherein the rotary actuator ring does not move axially, and the collection dish is elastically deformable so as to follow the axial movement of the actuator rod.

9. A dispenser according to claim 8, wherein the collection dish is fastened to the central cap of the transmission member, which central cap advantageously forms a connection bushing that is connected to the actuator rod, and an endpiece that is connected to the collection dish.

10. A dispenser according to claim 1, wherein the resilient means are formed by the rotary actuator member.

11. A dispenser according to claim 1, wherein the transmission member is engaged with the fluid reservoir at its bottom.

* * * * *